US009656183B2

(12) United States Patent
Wakabayashi

(10) Patent No.: US 9,656,183 B2
(45) Date of Patent: May 23, 2017

(54) PRINTED MATERIAL WITH STICKER AND METHOD FOR PRODUCING SAME

(71) Applicant: WE'LL CORPORATION, Ishikawa (JP)

(72) Inventor: Kazuyoshi Wakabayashi, Ishikawa (JP)

(73) Assignee: WE'LL CORPORATION, Ishikawa (JP)

( * ) Notice: Subject to any disclaimer, the term of this patent is extended or adjusted under 35 U.S.C. 154(b) by 0 days.

(21) Appl. No.: 15/035,334

(22) PCT Filed: Jun. 24, 2014

(86) PCT No.: PCT/JP2014/066642
§ 371 (c)(1),
(2) Date: May 9, 2016

(87) PCT Pub. No.: WO2015/072171
PCT Pub. Date: May 21, 2015

(65) Prior Publication Data

US 2016/0288011 A1 Oct. 6, 2016

(30) Foreign Application Priority Data

Nov. 12, 2013 (JP) ..... 2013-234320

(51) Int. Cl.
*A63H 33/38* (2006.01)
*G09F 3/10* (2006.01)
(Continued)

(52) U.S. Cl.
CPC ..... *A63H 33/38* (2013.01); *B42D 15/00* (2013.01); *B42D 15/04* (2013.01); *B42D 15/045* (2013.01);
(Continued)

(58) Field of Classification Search
CPC ..... A63H 33/38; B42D 15/00; B42D 15/04; B42D 15/045; G09F 3/10; G09F 3/00; G09F 23/10; G09F 1/08
See application file for complete search history.

(56) References Cited

U.S. PATENT DOCUMENTS 2,632,269 A * 3/1953 Sanders ..... G09F 21/04 116/173
5,472,240 A * 12/1995 Davies ..... B42D 15/042 156/250
(Continued)

FOREIGN PATENT DOCUMENTS

CN 2278595 Y 4/1998
CN 203264298 U 11/2013
(Continued)

OTHER PUBLICATIONS

International Search Report issued in Application No. PCT/JP2014/066642, mailed on Sep. 22, 2014 and English translation thereof (5 pages).
(Continued)

*Primary Examiner* — Patricia L Nordmeyer
(74) *Attorney, Agent, or Firm* — Nakanishi IP Associates, LLC

(57) ABSTRACT

A printed material with a sticker integrally includes a sticker and a mounting paper to be attached with the removed sticker. The printed material includes a sheet body that is applied with printing of at least the sticker and the mounting paper, a sticker region that is formed by folding at least a part of the sheet body, and a mounting paper region that is formed in a region other than the sticker region. In the printed material, at least one of the sticker formed in the sticker region is a standing sticker including a standing fold that extends in a transverse direction of the sheet body, and
(Continued)

an adhesive part and a non-adhesive part that are formed on a back surface of the sticker to face each other across the standing fold.

5 Claims, 5 Drawing Sheets

(51) Int. Cl.

| | |
|---|---|
| ***B42D 15/04*** | (2006.01) |
| ***G09F 23/10*** | (2006.01) |
| ***B42D 15/00*** | (2006.01) |
| ***G09F 1/08*** | (2006.01) |
| ***G09F 3/00*** | (2006.01) |

(52) U.S. Cl.
CPC ..... *G09F 1/08* (2013.01); *G09F 3/00* (2013.01); *G09F 3/10* (2013.01); *G09F 23/10* (2013.01); *Y10T 428/14* (2015.01)

(56) References Cited

U.S. PATENT DOCUMENTS

| | | | | |
|---|---|---|---|---|
| 5,582,888 | A * | 12/1996 | Volkert | B41F 17/02 283/56 |
| 6,261,658 | B1 * | 7/2001 | Schmidt | G09F 1/14 283/81 |
| 6,413,603 | B1 * | 7/2002 | Horton | A47G 23/0303 428/220 |

FOREIGN PATENT DOCUMENTS

| | | | |
|---|---|---|---|
| JP | 3072691 | U | 10/2000 |
| JP | 2003-022013 | A | 1/2003 |
| JP | 3094543 | U | 6/2003 |
| JP | 2004-314621 | A | 11/2004 |
| JP | 2005-288926 | A | 10/2005 |
| JP | 2006-082542 | A | 3/2006 |
| JP | 2007-334037 | A | 12/2007 |

OTHER PUBLICATIONS

Written Opinion of the International Searching Authority issued in International Application No. PCT/JP2014/066642 mailed on Sep. 22, 2014 and English translation thereof (9 pages).

"Gekijoban Pocket Monster Diamond Pearl Seal de Tsukuro Tobidasu! Pokemon World 2 Shu", published Jul. 1, 2010, and partial English translation thereof (4 pages).

"Pocket Monster Best Wish Seal de Tsukuro Tobidasu! Pokemon World (Zen 2 Shu)", published Feb. 1, 2011, and partial English translation thereof (6 pages).

Bullet Monkey, "Pokemon DP Seal de Tsukuro Tobidasu! Pokemon World" published Sep. 11, 2014, and partial English translation thereof (5 pages).

* cited by examiner

PRINTED MATERIAL WITH STICKER AND METHOD FOR PRODUCING SAME

CROSS-REFERENCE TO RELATED APPLICATION

The present application is based on and claims priority from Japanese Patent Application No. 2013-234320, filed on Nov. 12, 2013, the disclosure of which is hereby incorporated by reference in its entirety.

This invention is related to a printed material with a sticker and to a method for producing the same. Such printed materials are used for flyers distributed for advertising, book-like toys, educational materials for children, materials inserted in magazines and books, or the like.

BACKGROUND ART

As disclosed in Patent Literature 1 (JP2007-334037A), an advertising sticker, the surface of which is printed with information to be informed and with an advertisement, has been known. To attach the sticker to a good, a release paper is removed from the sticker and disposed of.

In Patent Literature 2 (JP2006-82542A), a home-delivery invoice is made of a sticker. When removing the sticker on which delivery information is written, an advertisement printed on the release paper of the invoice appears.

Further, Patent Literature 3 (JP2004-314621A) discloses a sticker mount having an advertising space for preventing a user from forgetting to take a medicine. The sticker mount having an advertising space is configured to be a single sheet that includes a sticker and a sticker mount to which the removed sticker is attached.

SUMMARY

The printed materials with a sticker disclosed in Patent Literatures 1 to 3, however, have a planar shape. That is, the printed materials of Patent Literature 1 to 3 are not used for providing a three-dimensional shape. Further, although Patent Literatures 1 to 3 do not disclose a method for producing the printed materials with a sticker, it should be assumed that a conventional method for producing a sticker is applied to produce them.

An object of the present invention is, therefore, to provide a printed material with a sticker that is applicable to provide a three-dimensional shape with a simple production process as well as a method for producing the same.

Solution to Problem

In order to achieve the object, an aspect of a printed material with a sticker of the invention includes a sticker and a mounting paper to be attached with the removed sticker. The printed material also includes a sheet body that is applied with printing of at least the sticker and the mounting paper, a sticker region that is formed by folding at least a part of the sheet body, and a mounting paper region that is formed in a region other than the sticker region. Here, at least one of the sticker formed in the sticker region is a standing sticker including a standing fold that extends in a transverse direction of the sheet body, and an adhesive part and a non-adhesive part that are formed on a back surface of the sticker to face each other across the standing fold.

DESCRIPTION OF EMBODIMENT

Figure 1:
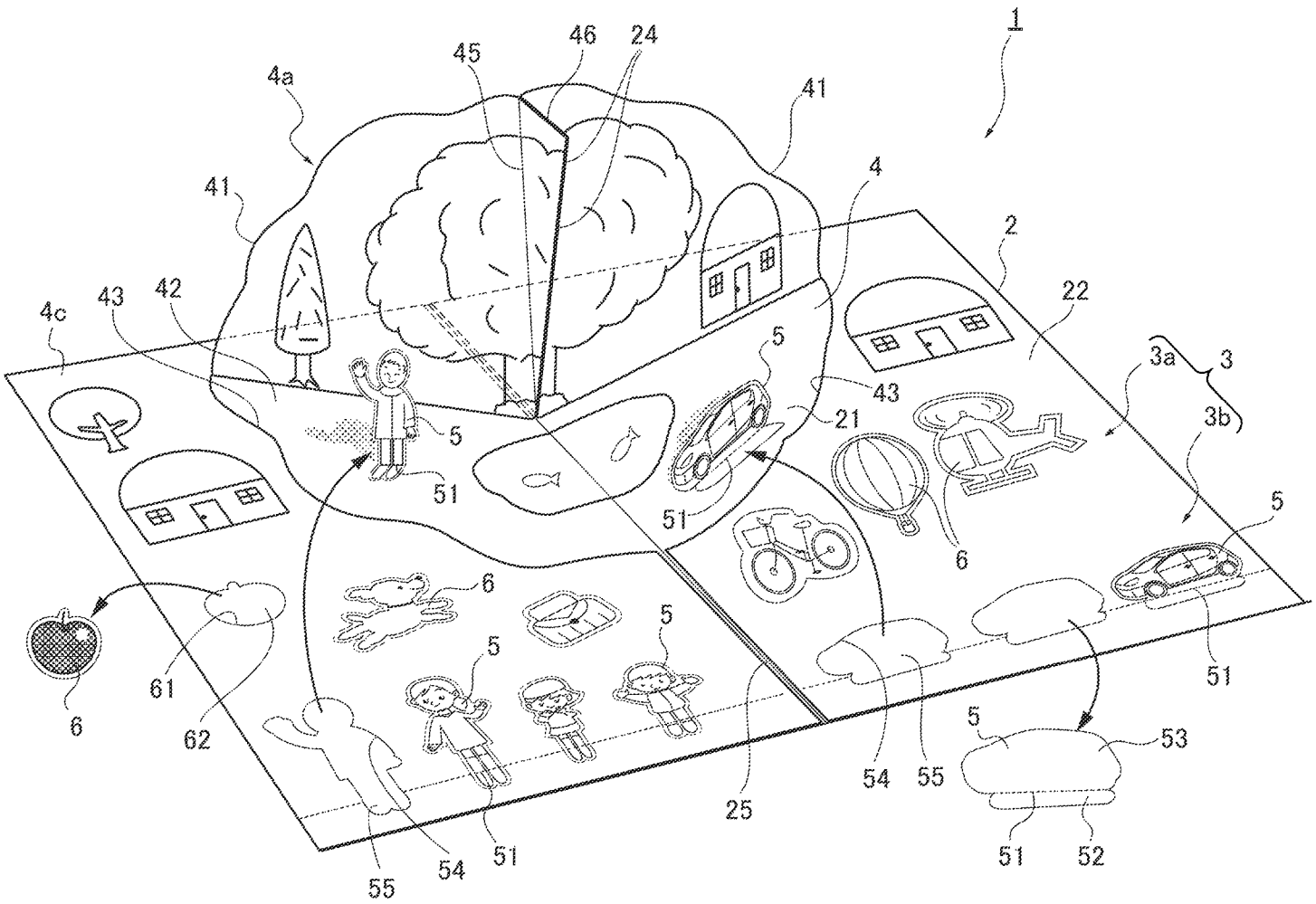
FIG. 1 is an explanatory view for explaining a configuration of a sticker book according to an embodiment.

Hereinafter, a sticker book 1 as a printed material with a sticker according to an embodiment of this invention will be described with reference to the drawings. FIG. 1 is an explanatory view for explaining a configuration of the sticker book 1 according to the embodiment.

The sticker book 1 includes a sheet body 2, a sticker region 3 formed on the sheet body 2, and a mounting paper region 4 formed on the sheet body 2 other than the sticker region 3. Here, the both sides of the sheet body 2 are printed.

Figure 2:
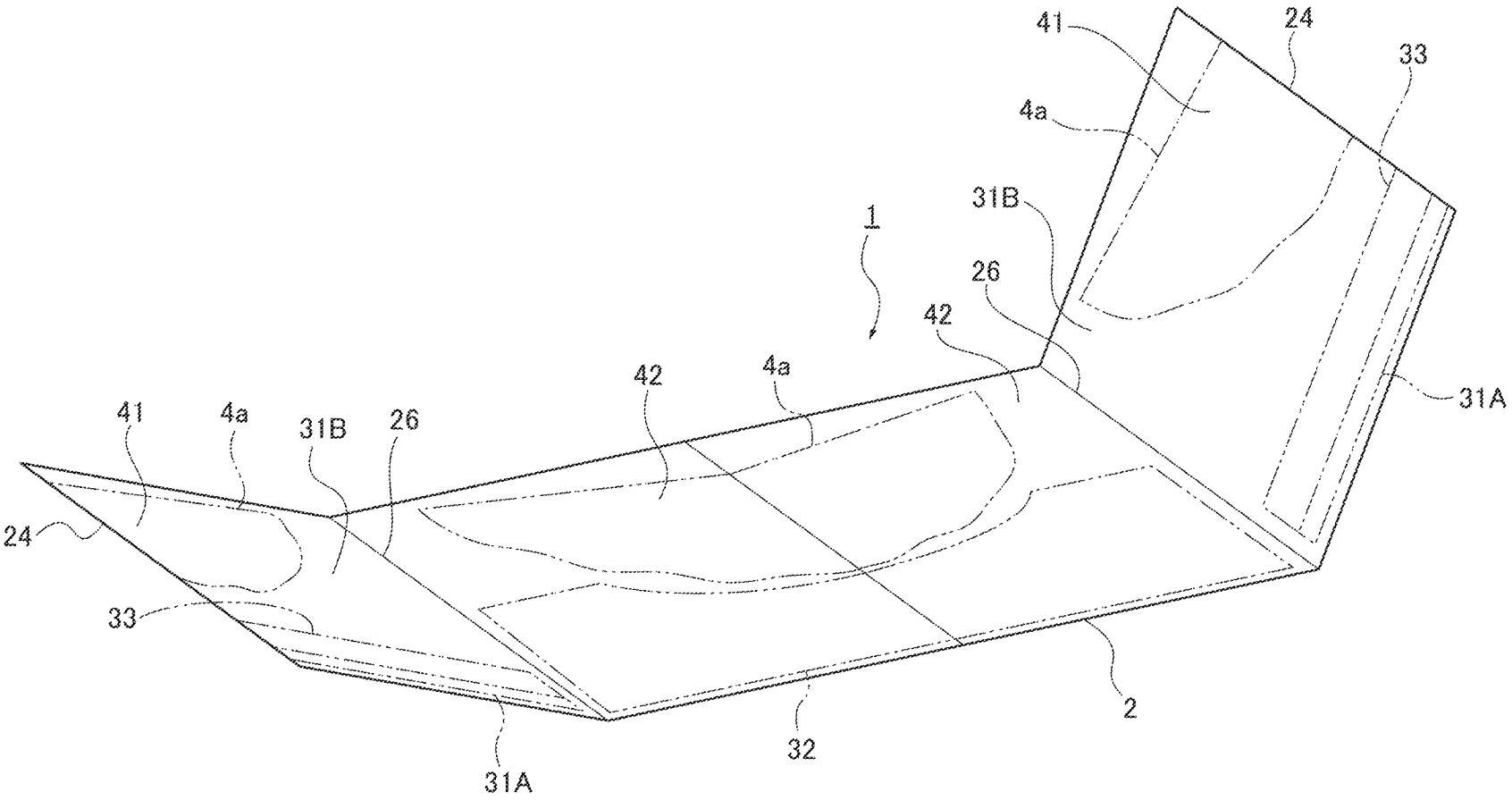
FIG. 2 is a perspective view for explaining an adhesive layer, a coating layer, and a non-adhesive layer.

As illustrated in FIGS. 1 and 2, the sheet body 2 has a rectangular shape. A first surface 21 (i.e., the upper-part surface) of the sheet body 2 is printed with, for example, drawings and/or character information. Here, the printed region represents the mounting paper region 4. A second surface 22 (i.e., the lower-part surface) of the sheet body 2 is also printed with, for example, drawings and/or character information, and the printed region on the second surface 22 is referred to as a peripheral mounting paper portion 4*c*.

Further, drawings, character information, and/or the like on the sticker region 3 are provided by double-sided printing on the sheet body 2. As illustrated in FIG. 2, the sticker region 3 is formed by folding the sheet body 2. As described later, surfaces of a standing sticker 5 and a sticker 6 are formed by printing the second surface 22 of the sheet body 2; while back faces of the standing sticker 5 and the sticker 6 are formed by printing the first surface 21 of the sheet body 2. Note that peeling surface 55 (62) exposed in a cutoff line 54 (61) when removing the standing sticker 5 (or the sticker 6) is on the first surface 21 of the sheet body 2.

The sticker region 3 includes a flat-sticker region 3*a* having the flat-type stickers 6 and a standing-sticker region 3*b* having the standing stickers 5. Here, the stickers 6 are normal stickers and have pressure sensitive adhesive (hereinafter, may also referred to as adhesive) on the whole back faces.

As illustrated in FIG. 1, the standing stickers 5 have standing folds 51 extending in a transverse direction of the sheet body. The standing folds 51 may be perforated so as to be folded easily or may be indicated by a line. The standing folds 51 are preferably provided at the lower end parts of the standing stickers to have bigger standing parts.

The back face of each of the standing stickers 5 has an adhesive part 52 at a part lower than the standing fold 51 and has a non-adhesive part 53 at a part higher than the standing fold 51. By folding the standing sticker along the standing fold 51 at a substantially right angle and by attaching the adhesive part 52 onto the mounting paper region 4, the non-adhesive part 53 stands in a substantially orthogonal direction with respect to the surface of the mounting paper, thereby the standing sticker becomes a three-dimensional shape.

As illustrated in FIG. 2, in the sticker region 3, adhesive layers 31A and 31B, a coating layer 32, and non-adhesive layers 33 are formed on the first surface 21 of the sheet body 2. The adhesive layers 31A and 31B and the coating layer 32 are formed after printing the sheet body 2.

The adhesive layers 31A and 31B are formed by applying adhesive (pressure sensitive adhesive) for stickers onto the sheet body 2. The adhesive is, for instance, water-insoluble glue such as acrylic adhesive. Here, the adhesive layer 31A corresponds to the adhesive parts 52 of the standing stickers 5. Further, the adhesive layer 31B corresponds to the adhesive parts (not illustrated) of the stickers 6. Additionally, the non-adhesive layer 33 corresponds to the non-adhesive parts 53 of the standing stickers 5.

The coating layer 32 corresponds to the peeling surfaces 55 of the standing stickers 5 and peeling surfaces 62 of the stickers 6. Accordingly, the coating layer 32 may also be referred to as a peeling layer. A coating agent of the coating layer is, for instance, a silicon resin. As a silicon resin, a solvent-based silicon resin, a non-solvent-based silicon resin, an emulsion-based silicon resin, or the like may be used. For instance, a UV silicon resin may be used as the silicon resin.

Figure 4:
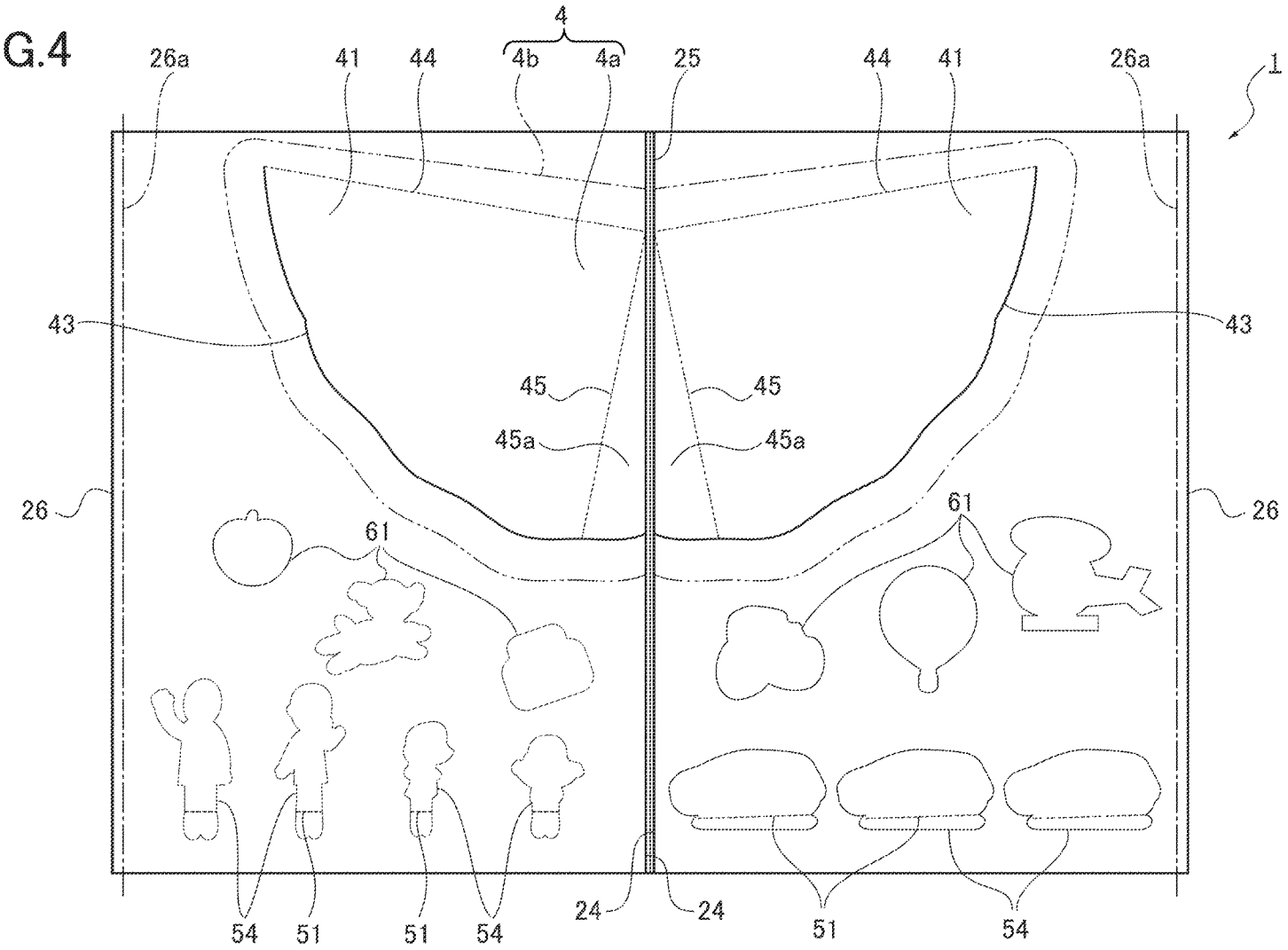
FIG. 4 is an overall view for explaining processing for forming a slit and a fold.

Next, the mounting paper region 4 will be described in detail. The mounting paper region 4 includes non-bonded parts 4*a*. The sheet body 2 is simply folded on the non-bonded part 4*a*. As illustrated in FIGS. 2 and 4, in the non-bonded parts 4*a*, neither a lower layer 42 nor upper layers 41, 41 are applied with adhesive. Note that the non-bonded parts 4*a* may be coated by the coating agent.

As illustrated in FIG. 4, a bonded part 4*b* is formed on the outer part of the peripheral edge of the non-bonded part 4*a*. The bonded part 4*b* has a ring-like shape and is formed by folding the sheet body 2 and by adhering to each other. The bonded part 4*b* may be formed by applying pressure sensitive adhesive or adhesive or may be a part of the adhesive layers 31B, 31B. Further, the lower layer 42 other than the coating layer 32, on which the adhesive layers 31B, 31B are folded, and the non-bonded parts 4*a* may be applied with adhesive. With this, the both sides of the part to be bonded become adhesive layers, and therefore, the adhesive force increases.

Mounting-paper-side standing folds 44, 44 and standing slits 43, 43 are formed along the peripheral edges of the upper layers 41, 41 of the non-bonded parts 4*a* such that the upper layers 41, 41 are standable without being cut and separated from the mounting paper region 4. To be specific, the non-bonded parts 4*a* are formed to face each other across the borders 24, 24, as illustrated in FIGS. 2 and 4. The borders 24, 24 abut against each other when the sheet body 2 is folded from both sides. The mounting-paper-side standing folds 44 are formed such that angles between the standing folds 44 and the corresponding borders 24 of the non-bonded parts 4*a* become obtuse angles. The mounting-paper-side standing folds 44 may be perforated so as to be folded easily or may be indicated by lines.

The standing slits 43 are formed to connect the edges of the standing folds 44 and the borders 24. As a result, by folding the upper layers 41 along the standing folds 44, the upper layers 41 stand. Here, an outer shape of the upper layers 41 are formed by the standing slits 43 and the borders 24.

Further, the upper layers 41 of the non-bonded parts 4*a* include bonding folds 45. The bonding folds 45 are formed in directions substantially orthogonal to the corresponding mounting-paper-side standing folds 44. The bonding folds 45 may also be perforated so as to be folded easily or may be indicated by lines.

The bonding folds 45, 45 of the upper layers 41, 41 on the both sides are folded and surfaces 45*a*, 45*a* of the isosceles triangles next to the borders are bonded to each other to form a bonded part 46. As a result, a back surface of the mounting paper region 4 becomes a three-dimensional shape like a wall. As described above, the angles between the mounting-paper-side standing folds 44 and the corresponding borders 24 of the non-bonded parts 4*a* are set to be obtuse angles, and the angles between the standing folds 44 and the corresponding bonding folds 45 are set to be substantially right angles. Therefore, it becomes possible to prevent both sides of a center fold 25 of the sticker book 1 from being lifted while having the bonded part 46.

Next, a usage of the sticker book 1 will be described with reference to FIG. 1. When distributed, the sticker book 1 is valley-folded along the center fold 25 and is closed like a book. In this closed-state, the drawings, character information, and/or the like printed on the second surface 22 of the sheet body 2 are exposed as a front surface cover and a back surface cover.

When opening the sticker book 1 along the center fold 25, the upper layers 41, 41 bonded together at the bonded part 46 of the non-bonded part 4*a* automatically stand from the standing slits 43, 43 using the standing folds 44, 44 as the standing points and the lower layer 42 is exposed. With this, the three-dimensional mounting paper region 4 is provided at an upper center section of the sticker book 1. Here, the exposed lower layer 42 as well as the upper layers 41, 41 and the peripheral mounting paper portion 4*c* around the lower layer 42 are all part of the mounting paper region 4.

The stickers 6 and the standing stickers 5 are removed from the sticker region 3 and attached onto the mounting paper region 4. Hence, the mounting paper region 4 is provided with, for example, drawings and/or character information in accordance with, for example, pictures and/or patterns on the stickers 6 and standing stickers 5. Note that the surfaces of the stickers 6 and standing stickers 5 are provided with the printings having independent meanings such as people, cars, animals, fruits, balls, and play tools.

A child who has this sticker book 1 removes any stickers 6 and standing stickers 5 and attaches the removed stickers onto the mounting paper region 4. For instance, the child may remove one of the standing stickers 5, fold the sticker 5 along the standing fold 51, and attach the adhesive part 52 thereof to the lower layer 42 in the mounting paper region 4 so as to arrange the people or cars three dimensionally.

Here, the front surface of the standing sticker 5 is printed with a person or an appearance of a car; while the back surface of the standing sticker 5 is printed with a back view of the person or the opposite side appearance of the car. Therefore, by standing the standing sticker, the child enjoys the printings provided on the front surface and the non-adhesive part 53 of the sticker. Additionally, the peeling surfaces 55 and 62 which are exposed in the cutoff lines 54 and 61 after removing the standing stickers 5 and stickers 6 may be provided with printings in accordance with the pictures, patterns, and the like on the mounting paper region 4. With this, the child enjoys the sticker region 3 even after removing the standing stickers 5 and the stickers 6.

Figure 3:
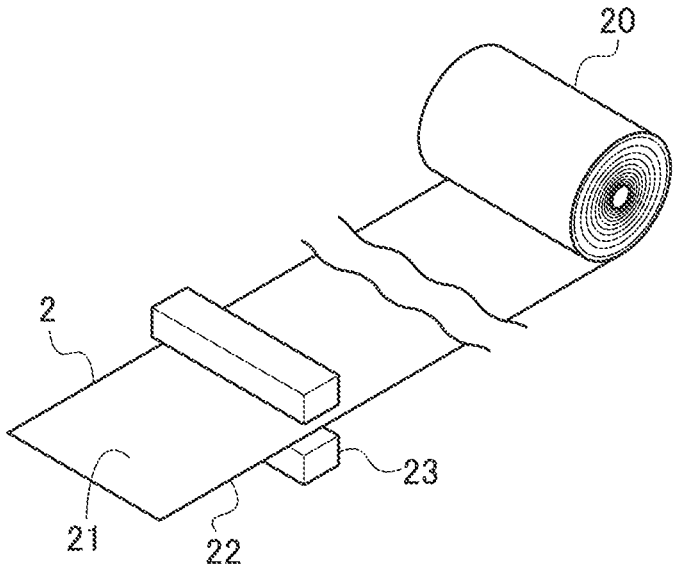
FIG. 3 is a schematic view for explaining printing processing of a method for producing the sticker book according to the embodiment.

Next, a method for producing the sticker book 1 of this embodiment will be described. As illustrated in FIG. 3, the sheet body 2 is pulled out from a roll paper 20, and both of the first surface 21 and second surface 22 of the sheet body 2 are printed by a both-sided printing machine. That is, the printing necessary to form the sticker region 3 and the mounting paper region 4 is completed during this processing.

After the printing processing, the sheet body 2 is wound up by a rewinding machine and set to an offline processing machine. The printed sheet body 2 is then pulled out from the offline processing machine and coated with UV silicon to form the coating layer 32 in a predetermined area on the first surface 21, as illustrated in FIG. 2.

After UV-curing the coating layer 32, the adhesive layers 31A and 31B are formed by applying adhesive in a prearranged area on the first surface 21. Accordingly, the adhesive layers 31A and 31B, the coating layer 32, and the other region (i.e., the non-adhesive layers 33 and the non-bonded parts 4*a*) are formed on the first surface 21. The non-adhesive layers 33 and the non-bonded parts 4*a* may be formed without applying adhesive. Alternatively, the non-adhesive layers 33 and the non-bonded parts 4*a* may be formed by applying topcoat printing on the corresponding area or by coating the corresponding area to remove the adhesiveness.

Further, by valley-folding the sheet body 2 along folds 26, 26 on the both sides of the coating layer 32 so as to bond the adhesive layers 31A, 31B to the coating layer 32; the sticker region 3 is formed. That is, in the sticker region 3, the coating layer 32 and the adhesive layers 31A, 31B face to each other by folding the sheet body 2. While maintaining this folded state, the sheet body 2 of only the upper layer, where the adhesive layers 31A and 31B are formed, is cut out by a die cutter along the sticker shapes to form the plurality of standing stickers 5 and stickers 6, as illustrated in FIG. 4.

Further, the standing folds 51 of the standing stickers 5 are perforated. Additionally, the mounting-paper-side standing folds 44 and bonding folds 45, 45 in the mounting paper region 4 are also perforated. Both ends of the sticker book 1 are trimmed along the folds 26, 26 formed outside of cutting lines 26*a*, 26*a*. Note that the above-described processing, i.e., printing processing, processing for forming the sticker region 3, and cutting processing, may be executed in a consistent processing.

Figure 5A:
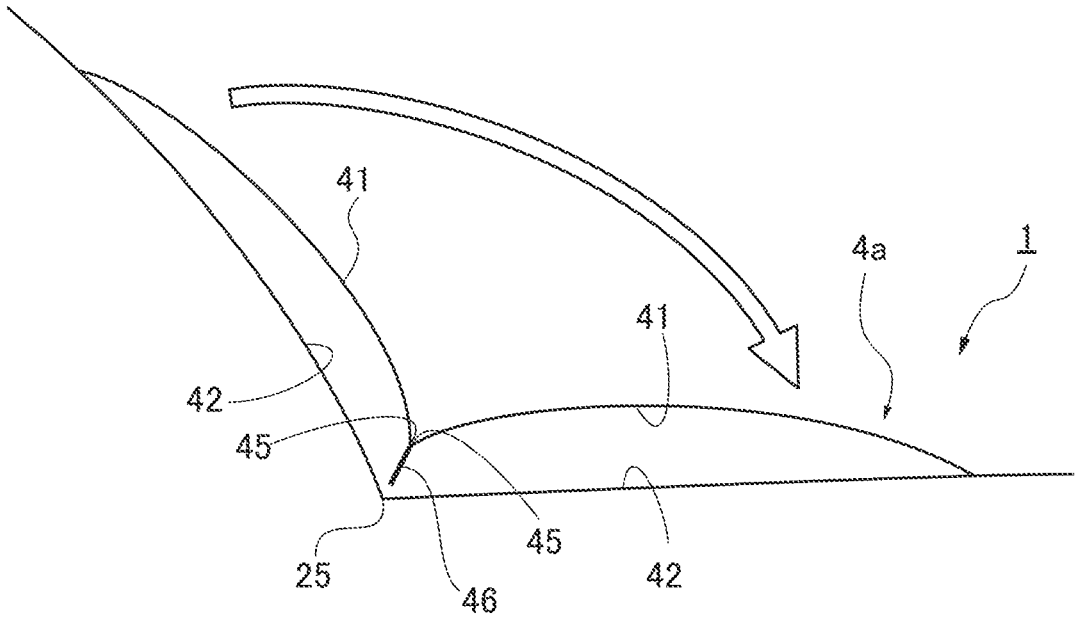
FIG. 5A is an explanatory view illustrating an open-state of a three-dimensional portion of a mounting paper region.
Figure 5B:
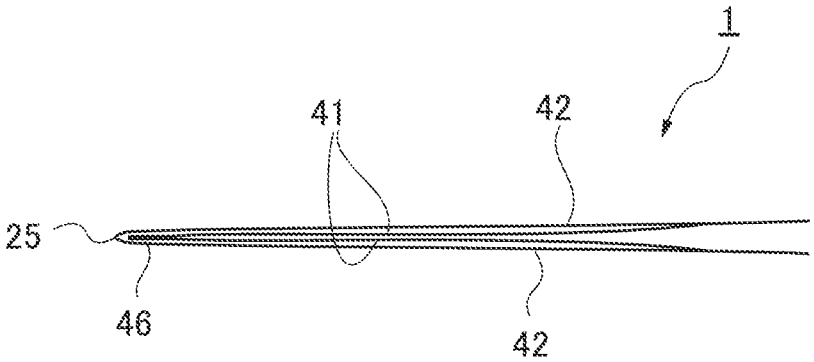
FIG. 5B is an explanatory view illustrating a closed-state of the three-dimensional portion of the mounting paper region.

Subsequently, as illustrated in FIG. 1, the upper layers 41, 41 are each stood, and the surfaces 45*a*, 45*a* of the upper layers are bonded to each other to provide the bonded part 46. As illustrated in FIG. 5B, although the upper layers 41, 41 are integrally bonded to each other at the bonded part 46, the sticker book 1 can be closed. To be specific, although the lower layers 42, 42 at the non-adhesive parts 4*a* are lifted from the upper layers 41, 41 as illustrated in FIG. 5A, the bonded part 46 is housed in the sticker book 1 at the center fold 25 and the sticker book 1 can be closed.

Next, an action of the sticker book 1 and the method for producing the sticker book 1 in accordance with this embodiment will be described.

With the sticker book 1 of the embodiment having the above-described configuration, the sticker region 3 and the mounting paper region 4 are formed by folding the sheet body 2 on which the stickers (5, 6) and mounting paper (4) are printed. By forming the stickers (5, 6) and mounting paper region 4 integrally, it becomes possible to avoid disposing a release paper and to prevent the stickers (5, 6) from attached to undesired spots such as furniture and walls.

Further, the standing stickers 5 provided in the sticker region 3 each include the standing fold 51 together with the adhesive part 52 and non-adhesive part 53 which are formed to face each other across the standing fold 51. By folding the standing fold 51 and attaching the adhesive part 52 onto the mounting paper region 4, it becomes possible to provide a three-dimensional shape with the standing sticker 5.

Further, the mounting-paper-side standing folds 44, 44 and standing slits 43, 43 are formed along the peripheral edges of the upper layers 41, 41 of the non-bonded parts 4*a*, which are formed by simply folding the sheet body 2, such that the upper layers 41, 41 are standable without being cut and separated from the mounting paper region 4. With this, the mounting paper region 4 also provides a three-dimensional shape. Besides, by adhering surfaces 45*a*, 45*a* of the edge peripheral parts of the upper layers 41, 41 of the standing non-adhesive parts 4*a*, it becomes possible to fold and close the printed material like a book. Besides, it becomes possible to close the sticker book 1 like a normal book and the upper layers 41, 41 naturally stand when the sticker book 1 is opened.

Further, the sticker region 3 is provided by forming and bonding the coating layer 32 and the adhesive layers 31A and 31B on the sheet body 2 together with the printing processing of the sheet body 2. Therefore, the sticker book 1 having the standing stickers 5 is easily produced. Besides, by adding processing to form the standing slits 43, 43 at the non-adhesive parts 4*a*, the mounting paper region 4 easily becomes a three-dimensional shape The sticker book 1 as described with the embodiment may be used for flyers distributed for advertising. Specifically, by printing advertisement and/or other information in the mounting paper region 4 and the sticker region 3, the sticker book 1 will not be disposed while a child is playing with the sticker book 1 so as to exhibit advertisement effects to the parents.

Alternatively, the sticker book 1 may be a book-like toy that also used as a guide book of a zoo or an amusement park. For instance, the standing stickers 5 may be printed with animals such as lions and giraffes such that a child can enjoy putting animals in the map of the park. Alternatively, the sticker book 1 may be used for educational materials for children or materials inserted in magazines or books. For instance, the mounting paper region 4 may be printed with the solar system or the Milky Way while the standing stickers 5 may be printed with planets such as the earth and Saturn such that children can learn the positional relationships of the universe with enjoyment.

Additionally, with the double-sided printing on the sheet body 2, a lot of data such as information about advertising and pictures for children can be printed thereon. Besides, the back surface of the stickers (5, 6) and the peeling surfaces 55 and 62 that are exposed when removing the stickers (5, 6) may also be printed with drawings and information. With this, it increases enjoyment in removing the stickers (5, 6) and prevents the children from feeling that they have finished using the sticker region 3. Therefore, the children can enjoy the stickers together with the mounting paper region longer than before.

Although the embodiment of the present invention has been described with reference to the drawings, specific configurations of the present invention should not be limited to the embodiment. It should be appreciated that variations or modifications may be made in the embodiment without departing from the scope of the present invention.

For instance, in the above embodiment, the both sides (21, 22) of the sheet body 2 are printed. However, the printing should not be limited to the both-side printing and may be one-side printing. Besides, it is not necessary to print the whole surfaces of the sheet body. The printing may be applied only to the area in which the printing is required.

Further, the above embodiment is described with the sticker book 1 that is configured by folding the both sides of the sheet body 2 to be the two-layer structure with the upper layer and the lower layer. However, it should not be limited thereto, and only a part of the sheet body 2 may be folded to form the sticker region 3.

Further, the above embodiment is described with the sticker book having both the flat-type stickers 6 and the standing stickers 5. However, it should not be limited thereto, and all of the stickers may be configured to be the standing stickers. Besides, in the above embodiment, the folds (51, 44, and 45) are formed by perforation. However, it should not be limited thereto. The folds may be formed by folding lines or grooves.

Further, in the above embodiment, the standing upper layers 41, 41 at the non-bonded parts 4*a* are integrally bonded at the bonded part 46. However, it should not be limited thereto. For instance, as long as the both ends of the mounting-paper-side standing fold at the non-bonded part are continuously connected to each other though the standing slit, the border, and the like, it is possible to form the mounting paper region in a three-dimensional shape by standing the upper layers along the mounting-paper-side standing fold.

The invention claimed is:

1. A printed material integrally including a sticker and a mounting paper, wherein the sticker is configured to be removed from the printed material and afterward attached on a mounting paper region formed in a part of the mounting paper, the printed material comprising:

a sheet body that is applied with printing, the sheet body including the sticker and the mounting body; and a sticker region that is formed by folding at least a part of the sheet body, wherein the mounting paper region is formed in a region other than the sticker region; and wherein at least one of the sticker formed in the sticker region is a standing sticker including a standing fold that extends in a transverse direction of the sheet body, and an adhesive part and a non-adhesive part that are formed on a back surface of the sticker, the adhesive part being formed at one side above the standing fold and the non-adhesive part being formed at another side below the standing fold.

2. The printed material according to claim 1, further comprising:

a non-bonded part that is formed by simply folding the sheet body in the mounting paper region; and a bonded part that is formed by bonding the folded sheet body on an outer part of a peripheral edge of the non-bonded part, wherein the non-bonded part includes a mounting-paper-side standing fold and a standing slit that are formed along a peripheral edge of an upper layer of the non-bonded part such that the upper layer is standable without being cut and separated from the mounting paper region.

3. The printed material according to claim 2, further comprising borders that abut against each other when the sheet body is folded from both sides, wherein the non-bonded parts are formed to face each other across the borders, the mounting-paper-side standing folds are formed such that angles between the mounting-paper-side standing folds and the corresponding borders are obtuse angles, and surfaces around the borders of the standing upper layers of the non-bonded parts are bonded.

4. The method for producing the printed material according to claim 2, comprising:

a step of applying printing on the sheet body to form the sticker and the mounting paper;

a step of forming a coating layer in an area corresponding to a peeling surface of the sticker on a first surface of the sheet body;

a step of forming an adhesive layer other than the coating layer on the first surface of the sheet body, a non-adhesive part of the standing sticker, and the non-bonded part;

a step of bonding the adhesive layer by folding the sheet body; and a step of forming a shape of a sticker including the standing sticker and the standing slit of the non-bonded part by cutting out the upper layer of the bonded sheet body.

5. A method for producing the printed material according to claim 1, comprising:

a step of applying printing on the sheet body to form the sticker and the mounting paper;

a step of forming a coating layer in an area corresponding to a peeling surface of the sticker on a first surface of the sheet body;

a step of forming an adhesive layer other than a non-adhesive part of the standing sticker in the sticker region on the first surface of the sheet body;

a step of forming the sticker region by folding the sheet body to bond the adhesive layer and the coating layer; and a step of forming a shape of a sticker including the standing sticker by cutting out an upper layer of the sheet body in the sticker region.

* * * * *